US008870625B2

(12) United States Patent
Togawa et al.

(10) Patent No.: US 8,870,625 B2
(45) Date of Patent: Oct. 28, 2014

(54) METHOD AND APPARATUS FOR DRESSING POLISHING PAD, PROFILE MEASURING METHOD, SUBSTRATE POLISHING APPARATUS, AND SUBSTRATE POLISHING METHOD

(75) Inventors: Tetsuji Togawa, Tokyo (JP); Keisuke Namiki, Tokyo (JP); Satoru Yamaki, Tokyo (JP)

(73) Assignee: Ebara Corporation, Tokyo (JP)

( * ) Notice: Subject to any disclaimer, the term of this patent is extended or adjusted under 35 U.S.C. 154(b) by 1090 days.

(21) Appl. No.: 12/292,685

(22) Filed: Nov. 24, 2008

(65) Prior Publication Data

US 2009/0137190 A1 May 28, 2009

(30) Foreign Application Priority Data

Nov. 28, 2007 (JP) ..... 2007-307458
Nov. 10, 2008 (JP) ..... 2008-288107

(51) Int. Cl.

| | |
|---|---|
| ***B24B 49/00*** | (2012.01) |
| ***B24B 53/02*** | (2012.01) |
| ***B24B 37/013*** | (2012.01) |
| ***B24B 49/10*** | (2006.01) |
| ***B24B 53/017*** | (2012.01) |
| ***B24B 49/16*** | (2006.01) |

(52) U.S. Cl.

CPC ..... *B24B 53/017* (2013.01); *B24B 37/013* (2013.01); *B24B 49/10* (2013.01); *B24B 49/16* (2013.01)

USPC ..... 451/8; 451/56; 451/443; 451/287

(58) Field of Classification Search

USPC ..... 451/8, 56, 443, 444, 285–289, 5

See application file for complete search history.

(56) References Cited

U.S. PATENT DOCUMENTS

| | | | | |
|---|---|---|---|---|
| 5,860,847 | A * | 1/1999 | Sakurai et al. | 451/10 |
| 5,875,559 | A | 3/1999 | Birang et al. | |
| 6,126,530 | A * | 10/2000 | Hirata | 451/444 |
| 6,302,772 | B1 * | 10/2001 | Hosoki et al. | 451/56 |
| 6,602,119 | B1 * | 8/2003 | Togawa et al. | 451/72 |
| 6,609,962 | B1 | 8/2003 | Wakabayashi et al. | |
| 6,623,344 | B2 * | 9/2003 | Inaba | 451/443 |
| 6,695,684 | B2 * | 2/2004 | Park et al. | 451/56 |
| 6,769,972 | B1 * | 8/2004 | Huang et al. | 451/287 |
| 6,896,583 | B2 * | 5/2005 | Rodriquez et al. | 451/5 |

(Continued)

FOREIGN PATENT DOCUMENTS

| | | |
|---|---|---|
| JP | 9-168963 | 6/1997 |
| JP | 2006-093296 | 4/2006 |

*Primary Examiner* — Dung Van Nguyen

(74) *Attorney, Agent, or Firm* — Wenderoth, Lind & Ponack, L.L.P.

(57) ABSTRACT

A dressing method is used to dress a polishing pad of a polishing apparatus for polishing a substrate. This method includes repetitively moving the dresser on an upper surface of the polishing pad in a radial direction of the polishing pad so as to perform a dressing process on the polishing pad, during the dressing process, measuring a height of an upper surface of the polishing pad at a predetermined point in one of plural zones on the polishing surface, and repeating the repetitive moving of the dresser and the measuring of the height of the upper surface of the polishing pad so as to measure the height of the upper surface of the polishing pad in all of the plural zones.

13 Claims, 12 Drawing Sheets

(56) References Cited

U.S. PATENT DOCUMENTS 6,957,997 B2 * 10/2005 Marxsen et al. ..... 451/5
7,018,269 B2 * 3/2006 Anderson ..... 451/5
7,201,635 B2 * 4/2007 Chandrasekaran ..... 451/9
7,258,596 B2 * 8/2007 Elledge et al. ..... 451/6
7,846,006 B2 * 12/2010 Stinson et al. ..... 451/5
8,221,191 B2 * 7/2012 Matsuzaki ..... 451/5

* cited by examiner

METHOD AND APPARATUS FOR DRESSING POLISHING PAD, PROFILE MEASURING METHOD, SUBSTRATE POLISHING APPARATUS, AND SUBSTRATE POLISHING METHOD

BACKGROUND OF THE INVENTION

1. Field of the Invention

The present invention relates to a method and apparatus for dressing a polishing pad on a polishing table by pressing a dresser against the polishing pad, and also relates to a polishing pad profile measuring method, a substrate polishing apparatus, and a substrate polishing method.

2. Description of the Related Art

Recent progress in high integration of semiconductor devices results in smaller wiring patterns and narrower distances between interconnects. Photolithography is one of the device fabrication processes. In this photolithography, a stepper requires a highly flat image plane, particularly when forming interconnects of at most 0.5 μm wide, because a depth of focus is small. Thus, a polishing apparatus, which performs Chemical Mechanical Polishing (CMP), is used for planarizing a surface of a semiconductor wafer.

Conventionally, as shown in FIG. 1, a polishing apparatus of this type typically includes a polishing table 102 holding, on its upper surface, a polishing pad (or a polishing cloth) 100 that provides a polishing surface, and a top ring 104 for holding a substrate (e.g., a semiconductor wafer) W which is a workpiece to be polished. The top ring 104 rotates the substrate W and presses the substrate W against the polishing pad 100 on the rotating polishing table 102 at constant pressure, while a nozzle 106 supplies a polishing liquid onto the polishing pad 100, to thereby polish a surface of the substrate W to flat mirror finish. Examples of the polishing liquid to be used include an alkaline solution with abrasive grains, such as fine particles of silica, suspended therein. With use of such polishing liquid, the substrate W is chemically and mechanically polished by a combination of a chemical polishing action of the alkaline solution and a mechanical polishing action of the abrasive grains.

The polishing apparatus also has a dressing apparatus disposed adjacent to the polishing table 102. This dressing apparatus includes a dresser 108 for restoring the polishing surface of the polishing pad 100 that has been deteriorated through the polishing process. The dresser 108 is configured to rotate about its own axis and bring a dressing surface thereof into contact with the polishing surface of the polishing pad 100 on the rotating polishing table 102 to thereby remove the polishing liquid and debris on the polishing surface and also planarize and dress the polishing surface of the polishing pad 100. Typically, a diamond dresser is used as the dresser 108 for scraping and planarizing the polishing surface of the polishing pad 100. A uniformity of the dressed polishing surface greatly affects polishing accuracy in subsequent polishing processes of substrates.

When the dresser 108 is replaced with a new dresser, the following problems may arise. Since individual dressers have different properties, the new dresser can have a different cutting rate of the polishing pad. As a result, a removal rate and a polishing profile may change. After the dresser 108 is replaced with a new dresser, preconditioning of the new dresser is usually performed by pressing the new dresser against the polishing pad 100 at given pressure. This preconditioning process is, however, problematic because it may adversely affect a polishing performance at an initial stage of polishing the substrate W. In addition, a slurry, that has been removed by the dressing process, may be deposited firmly on the dresser 108, and may adversely affect a stability of the polishing performance.

SUMMARY OF THE INVENTION

It is therefore an object of the present invention to provide a dressing method and a dressing apparatus which can enable a newly replaced dresser to keep a constant cutting rate of the polishing pad; can prevent variations in the removal rate and the polishing profile caused by individual dressers with different properties; can precondition a newly installed dresser without adversely affecting the polishing pad; and can prevent deposition of a solid slurry on the dresser. Another object of the present invention is to provide a profile measuring method. Still another object of the present invention is to provide a substrate polishing apparatus and a substrate polishing method capable of obtaining a profile of the polishing pad from a cutting rate measured by a dresser. Still another object of the present invention is to provide a substrate polishing apparatus and a substrate polishing method capable of performing polishing of a substrate in accordance with a pad profile.

In order to solve the above-mentioned drawbacks, one aspect of the present invention provides a method of measuring a profile of a polishing pad dressed by a dresser under a predetermined dressing condition. This method includes repetitively moving the dresser on an upper surface of the polishing pad in a radial direction of the polishing pad so as to perform a dressing process on the polishing pad, during the dressing process, measuring a height of an upper surface of the polishing pad at a predetermined point in one of plural zones on the polishing surface, the plural zones being arranged along the radial direction of the polishing pad, and repeating the repetitive moving of the dresser and the measuring of the height of the upper surface of the polishing pad so as to measure the height of the upper surface of the polishing pad in all of the plural zones.

According to the present invention as described above, the profile of the polishing pad can be measured without using an expensive high-performance data processing device.

In a preferred aspect of the present invention, the method further includes further repeating the repetitive moving of the dresser and the measuring of the height of the upper surface of the polishing pad so as to obtain measurements for the respective zones, and calculating averages, each representing the height of the upper surface in each zone, from the measurements.

According to the present invention as described above, the profile of the polishing pad can be measured accurately.

Another aspect of the present invention is to provide a method of dressing a polishing pad on a polishing table. This method includes dressing the polishing pad by pressing the dresser against the polishing pad under a predetermined dressing condition, measuring a cutting rate of the polishing pad, and feeding back the cutting rate to the predetermined dressing condition.

According to the present invention as described above, the cutting rate of the polishing pad can be kept constant even when the dresser is replaced with a new dresser. Therefore, variations in the removal rate and the polishing profile caused by individual dressers with different properties can be prevented.

Another aspect of the present invention is to provide a dressing apparatus for dressing a polishing pad on a polishing table. The apparatus includes a dresser configured to dress the polishing pad by pressing the polishing pad under a predetermined dressing condition, a dresser operation controller configured to control an operation of the dresser and establish the predetermined dressing condition, and a cutting rate measuring section configured to measure a cutting rate of the polishing pad and feed back the cutting rate measured to the dresser operation controller. The dresser operation controller is configured to reflect the cutting rate in the predetermined dressing condition.

According to the present invention as described above, the cutting rate of the polishing pad can be kept constant even when the dresser is replaced with a new dresser.

In a preferred aspect of the present invention, the cutting rate measuring section is configured to measure the cutting rate by detecting at least one of a change in torque current of a motor which drives the polishing table, a change in torque current of a motor which drives the dresser, and a change in vertical position of a contact surface of the dresser when contacting the polishing pad.

Another aspect of the present invention is to provide a dressing apparatus for dressing a polishing pad on a polishing table. This apparatus includes a dresser configured to dress the polishing pad by pressing an upper surface of the polishing pad, the dresser being operable to swing in a predetermined range including the upper surface of the polishing pad, and a dresser-preconditioning device configured to precondition the dresser. The dresser-preconditioning device is provided in a portion of the predetermined range outside of the upper surface of the polishing pad.

According to the present invention as described above, preconditioning of the dresser can be performed without affecting the polishing pad in use.

In a preferred aspect of the present invention, the dresser-preconditioning device includes a cutting rate measuring device configured to measure a cutting rate of the polishing pad.

According to the present invention as described above, an end point of preconditioning of the dresser can be detected.

In a preferred aspect of the present invention, the dressing apparatus further includes a service life determining device configured to determine a service life of the dresser based on the cutting rate measured by the cutting rate measuring device.

According to the present invention as described above, the dresser can be replaced when the service life of the dresser is about to expire. Therefore, an optimal condition of the polishing pad can be maintained.

In a preferred aspect of the present invention, the dresser-preconditioning device includes a torque current measuring section configured to measure a torque current of a motor which drives the dresser, and an end point detector configured to detect an end point of preconditioning of the dresser, based on the torque current measured by the torque current measuring section.

In a preferred aspect of the present invention, the dressing apparatus further includes a cleaning device configured to clean a dressing surface of the dresser while the dresser is being preconditioned by the dresser-preconditioning device.

According to the present invention as described above, a slurry and solid debris, attached to the dresser during dressing, can be removed, and the deposition of the slurry and the solid debris on the dresser can be prevented. Therefore, the dresser can be maintained in a suitable condition for dressing of the polishing pad.

Another aspect of the present invention is to provide a dressing apparatus for dressing a polishing pad on a polishing table. This apparatus includes a dresser configured to rotate about its own axis and dress the polishing pad by pressing an upper surface of the polishing pad at a predetermined force, the dresser being coupled to a dresser arm, a dresser swinging mechanism configured to cause the dresser to swing on the upper surface of the polishing pad in radial directions of the polishing pad, a dresser position measuring device configured to measure a radial position of the dresser on the upper surface of the polishing pad, a cutting rate measuring device configured to measure a cutting rate of the polishing pad dressed by the dresser, a polishing pad profile measuring device configured to obtain a profile of the polishing pad from the cutting rate of the polishing pad measured at plural zones defined in the upper surface of the polishing pad, positions of the plural zones being measured by the dresser position measuring device, and a dresser operation controller configured to control an operation of the dresser. The profile of the polishing pad measured by the polishing pad profile measuring device is fed back to the dresser operation controller.

According to the present invention as described above, the profile of the polishing pad measured by the polishing pad profile measuring device is fed back to the dresser operation controller. Therefore, dressing of the polishing pad can be performed so as to conform to the actual profile. In other words, the actual profile can be changed into an ideal profile. The plural zones may be arranged along the radial direction of the polishing pad.

In a preferred aspect of the present invention, the dresser swinging mechanism includes a motor as a drive source for swinging the dresser arm, and the dresser position measuring device is configured to measure the radial position of the dresser from a pulse number supplied to the motor. A position control motor or a pulse motor (e.g., a stepping motor or servo motor) may be used as the motor.

Another aspect of the present invention is to provide a substrate polishing apparatus including a polishing table for supporting a polishing pad, a top ring configured to rotate a substrate and press the substrate against the polishing pad at a predetermined force while rotating the substrate, a top ring operation controller configured to control an operation of the top ring, a dresser configured to rotate about its own axis and dress the polishing pad by pressing an upper surface of the polishing pad at a predetermined force, the dresser being coupled to a dresser arm, a dresser swinging mechanism configured to cause the dresser to swing on the upper surface of the polishing pad in radial directions of the polishing pad, a dresser position measuring device configured to measure a radial position of the dresser on the upper surface of the polishing pad, a cutting rate measuring device configured to measure a cutting rate of the polishing pad dressed by the dresser, a polishing pad profile measuring device configured to obtain a profile of the polishing pad from the cutting rate of the polishing pad measured at plural zones defined in the upper surface of the polishing pad, positions of the plural zones being measured by the dresser position measuring device, a dresser operation controller configured to control an operation of the dresser, and a substrate profile measuring device configured to measure a removal profile of a film on the substrate. The profile of the polishing pad measured by the polishing pad profile measuring device is fed back to the dresser operation controller, and the removal profile of the film on the substrate measured by the substrate profile measuring device is fed back to the top ring operation controller.

According to the present invention as described above, polishing of the substrate and dressing of the polishing pad can be performed so as to conform to the actual profile based on the profile of the polishing pad. In other words, the actual profile can be changed into an ideal profile. Therefore, accuracy in polishing of the substrate and dressing of the polishing pad can be improved. Further, according to the present invention, the substrate can be polished to have an ideal removal profile of the film on the substrate using the polishing pad that has been dressed to have an ideal polishing pad profile.

In a preferred aspect of the present invention, the dresser swinging mechanism includes a motor comprising a position control motor or a pulse motor as a drive source for swinging the dresser arm, and the dresser position measuring device is configured to measure the radial position of the dresser from a pulse number supplied to the motor.

Another aspect of the present invention is to provide a substrate polishing apparatus including a polishing table for supporting a polishing pad, a top ring configured to rotate a substrate and press the substrate against the polishing pad at a predetermined force while rotating the substrate, the top ring having a substrate holding surface which is divided into plural regions, a top ring operation controller configured to control an operation of the top ring, a dresser configured to rotate about its own axis and dress the polishing pad by pressing an upper surface of the polishing pad at a predetermined force, the dresser being coupled to a dresser arm, a dresser swinging mechanism configured to cause the dresser to swing on the upper surface of the polishing pad in radial directions of the polishing pad, a dresser position measuring device configured to measure a radial position of the dresser on the upper surface of the polishing pad, a cutting rate measuring device configured to measure a cutting rate of the polishing pad dressed by the dresser, a polishing pad profile measuring device configured to obtain a profile of the polishing pad from the cutting rate of the polishing pad measured at plural zones defined in the upper surface of the polishing pad, positions of the plural zones being measured by the dresser position measuring device, a dresser operation controller configured to control an operation of the dresser, and a pressing force controller configured to control pressing forces of the regions in the substrate holding surface in accordance with a thickness of the polishing pad based on the profile of the polishing pad measured by the polishing pad profile measuring device.

According to the present invention as described above, appropriate polishing of the substrate can be performed in accordance with the profile of the polishing pad. For example, feedback control can be performed such that the pressing force of the region corresponding to a thin portion of the polishing pad is selectively adjusted to be higher than the pressing forces of the other regions of the substrate holding surface of the top ring.

Another aspect of the present invention is to provide a substrate polishing method including dressing a polishing pad on a polishing table by pressing a rotating dresser against an upper surface of the polishing pad at a predetermined force, during the dressing of the polishing pad, causing the dresser to swing on the upper surface of the polishing pad in radial directions of the polishing pad, measuring a radial position of the dresser on the upper surface of the polishing pad, measuring a cutting rate of the polishing pad at plural zones defined in the upper surface of the polishing pad, obtaining a profile of the polishing pad from the cutting rate of the polishing pad, holding a substrate by a top ring having a substrate holding surface divided into plural regions, pressing the substrate against the upper surface of the polishing pad while rotating the substrate, and during pressing of the substrate against the upper surface of the polishing pad, controlling pressing forces of the regions in the substrate holding surface in accordance with a thickness of the polishing pad based on the profile of the polishing pad.

According to the present invention as described above, appropriate polishing of the substrate can be performed in accordance with the profile of the polishing pad. For example, feedback control can be performed such that the pressing force of the region corresponding to a thin portion of the polishing pad is selectively adjusted to be higher than the pressing forces of the other regions of the substrate holding surface of the top ring.

In a preferred aspect of the present invention, the cutting rate of the polishing pad at each zone is a measurement of the cutting rate at a central portion of each zone in the polishing pad.

In a preferred aspect of the present invention, the cutting rate of the polishing pad at each zone is an average of measurements of the cutting rate at plural portions in each zone.

DETAILED DESCRIPTION OF THE INVENTION

Figure 1:
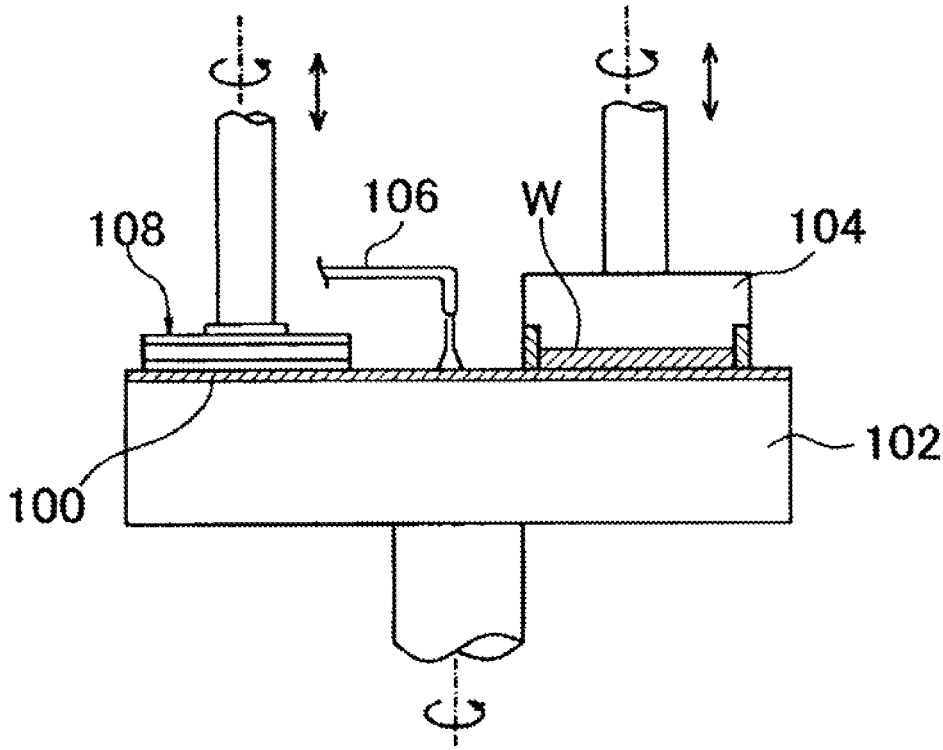
FIG.1 PRIOR ART
FIG. 1 is a view showing an example of a polishing apparatus having a conventional dressing apparatus.
Figure 2:
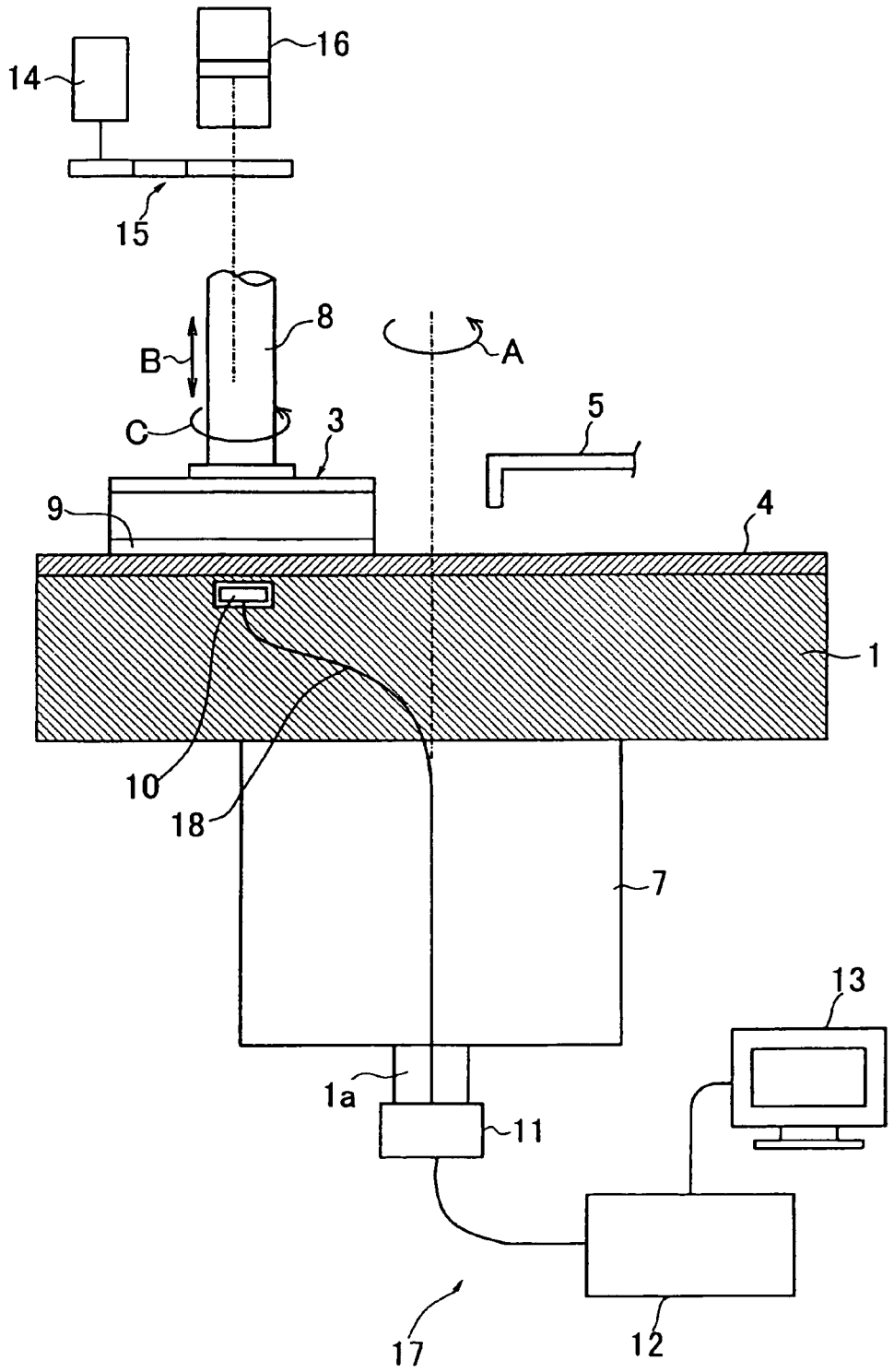
FIG. 2 is a schematic cross-sectional view showing an example of a polishing apparatus having a dressing apparatus according to an embodiment of the present invention.
Figure 3:
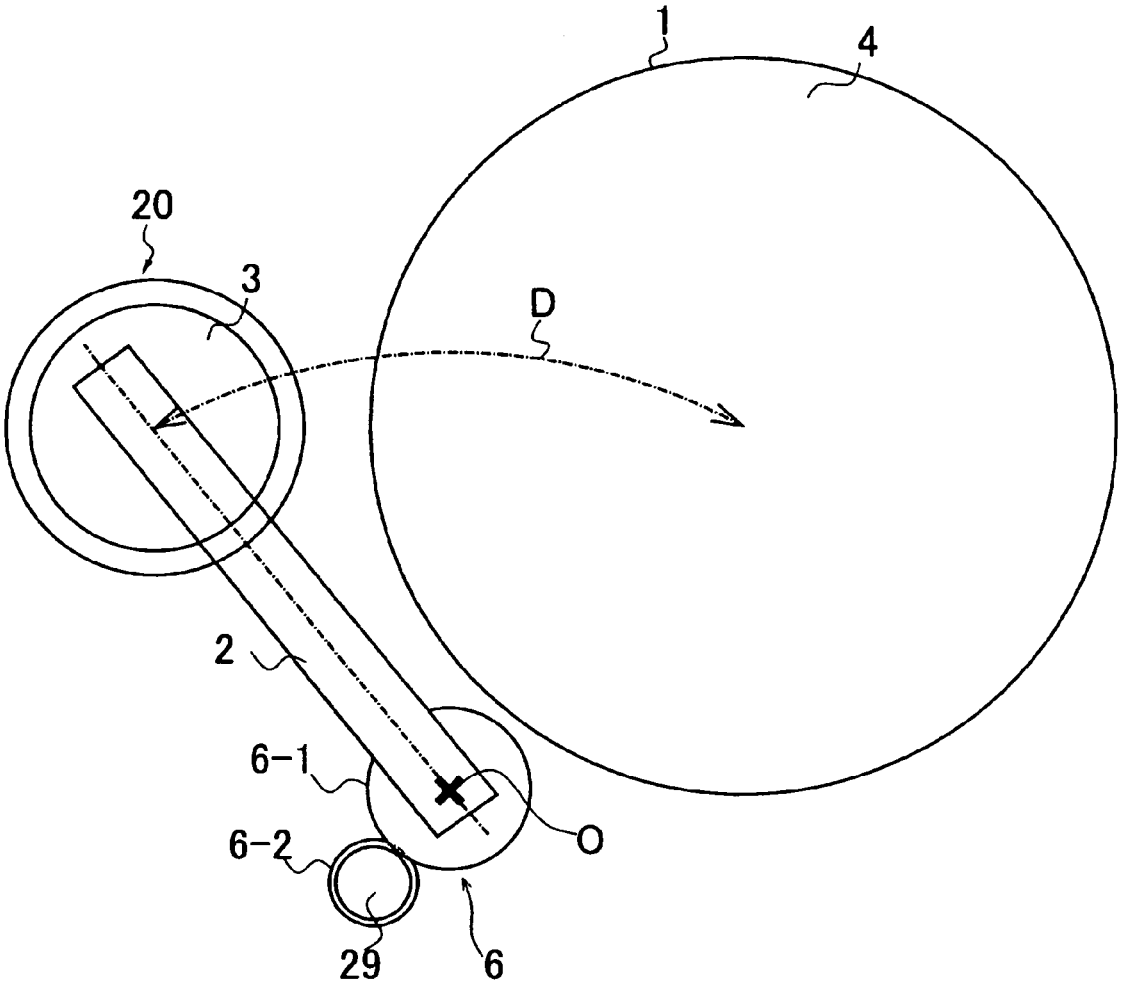
FIG. 3 is a schematic plan view of the polishing apparatus having the dressing apparatus according to the embodiment of the present invention.

An embodiment of the present invention will be now described with reference to the drawings. FIGS. 2 and 3 show a polishing apparatus having a dressing apparatus according to an embodiment of the present invention. As shown in FIGS. 2 and 3, the polishing apparatus according to the embodiment includes a polishing table 1 supporting a polishing pad 4 on an upper surface thereof, a top ring (not shown in the drawing) configured to hold a substrate, such as a semiconductor wafer, on a lower surface thereof and press the substrate against an upper surface of the polishing pad 4, and a dresser 3 configured to dress the upper surface of the polishing pad 4. The polishing table 1 is coupled to a motor 7 and is rotatable about its own axis as indicated by arrow A in FIG. 2.

The dresser 3 is coupled to a motor 14 via a power transmission mechanism 15 such as a gear assembly. The dresser 3 is further coupled to an elevating cylinder 16. The dresser 3 is vertically movable by the elevating cylinder 16 in directions indicated by arrow B. When dressing, the dresser 3 is moved downwardly by the elevating cylinder 16 to press the polishing pad 4 at certain pressure, while being rotated by the motor 14 about its own axis in a direction indicated by arrow C. The dresser 3 is coupled to a dresser shaft 8, and has a metal layer 9 providing a lower surface of the dresser 3. Diamond particles (not shown in the drawing) are firmly attached to the metal layer 9 by means of metal plating or the like. Above the polishing table 1, a dressing liquid supply nozzle 5 is provided for supplying a dressing liquid (typically pure water) onto the polishing pad 4 attached to the upper surface of the polishing table 1. The motor 14 and the elevating cylinder 16 are controlled by a dresser operation controller (not shown in the drawing) so as to operate the dresser 3 under desired dressing conditions including a pressing force applied by the dresser 3 to the polishing pad 4 and a rotational speed of the dresser 3.

The dresser 3 has a dresser arm 2 which is oscillated (swung) by a swinging mechanism 6 about a central axis 0 of a swing shaft (not shown in the drawing) in directions indicated by arrow D. The swinging mechanism 6 includes a gear 6-1, a gear 6-2, and a motor 29 as a drive source. A position control motor or a pulse motor may be used as the motor 29. More specifically, a servo motor or a stepping motor can be used as the motor 29. While the polishing table 1 and the dresser 3 are rotated about their own axes, the dresser 3 is lowered to press the diamond particles held on the metal layer 9 against the upper surface of the polishing pad 4 so as to scrape the upper surface of the polishing pad 4 via relative movement between the polishing pad 4 and the dresser 3, thereby dressing and restoring the upper surface of the polishing pad 4. The dressing apparatus further includes a dresser position measuring device (not shown) configured to detect a radial direction of the dresser 3 on the upper surface of the polishing pad 4 based on a pulse number supplied to the motor 29.

In this example, the swinging mechanism 6 is used to oscillate (swing) the dresser arm 2 in the radial directions of the polishing pad 4 as indicated by the arrow D. However, any type of moving mechanism, other than the swinging mechanism 6, can be employed as long as it can move the dresser 3 in the radial directions of the polishing pad 4.

An eddy-current sensor 10 is provided in the polishing table 1. This eddy-current sensor 10 is configured to induce an eddy current in the metal layer 9 of the dresser 3 by passing a high-frequency current through a sensor coil and to measure a thickness of the polishing pad 4 based on a magnitude of the eddy current induced in the metal layer 9. The polishing pad 4 is made of a dielectric material such as foamed polyurethane. Therefore, if the polishing pad 4 is thick, then the eddy current induced in the metal layer 9 of the dresser 3 is small, and if the polishing pad 4 is thin, then the eddy current induced in the metal layer 9 becomes large. The thickness of the polishing pad 4 can thus be determined by measuring the eddy current induced in the metal layer 9. The eddy-current sensor 10 has an output terminal connected to a wire 18, which extends to a controller 12 through the polishing table 1, a polishing table support shaft la, and a rotary connector 11 mounted on an end of the polishing table support shaft 1*a*. The controller 12 is coupled to a display unit 13. The eddy-current sensor 10, the controller 12, and the display unit 13 constitute an eddy-current-type polishing pad thickness detecting monitor 17. A slip ring may be used instead of the rotary connector 11.

Figure 9:
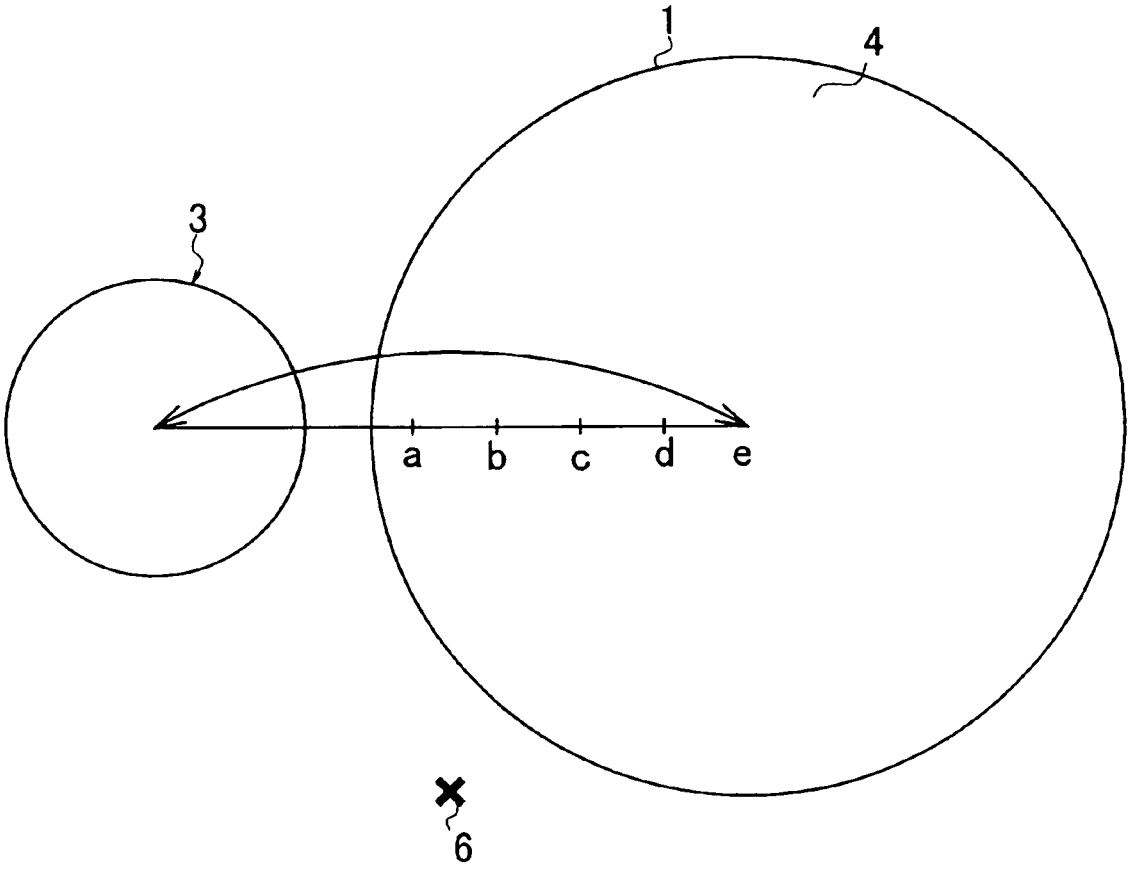
FIG. 9 is a plan view showing a process of measuring a profile of a polishing pad by the dressing apparatus according to the embodiment of the present invention

In this example, the single eddy-current sensor 10 is provided below the polishing pad 4 as shown in FIG. 2. Alternatively, plural eddy-current sensors may be provided below the polishing pad 4. In this case, as shown in FIG. 9, the upper surface of the polishing pad 4 may be divided into plural zones arranged along the radial direction of the polishing pad 4, and the eddy-current sensors may be provided in positions below central portions of the respective zones so as to measure thickness of the central portions of the respective zones.

With use of the eddy-current-type polishing pad thickness detecting monitor 17, a change in thickness of the polishing pad 4 is detected by the eddy-current sensor 10 based on the eddy current generated in the metal layer 9 of the dresser 3, a value of the eddy current detected by the eddy-current sensor 10 is displayed on the display unit 13, and the thickness of the polishing pad 4 is measured. Based on a signal from the eddy-current sensor 10, the controller 12 measures a cutting rate at which the dresser 3 cuts or dresses the polishing pad 4. This cutting rate measured is fed back from the controller 12 to the dresser operation controller which controls the motor 14 and the elevating cylinder 16, so that the cutting rate is reflected in the dressing conditions, e.g., the pressuring force of the dresser 3 applied by the elevating cylinder 16 to the polishing pad 4, the moving speed of the dresser 3 in the radial direction on the upper surface of the polishing pad 4, and the rotational speed of the dresser 3 rotated by the motor 14.

In this embodiment, the cutting rate of the polishing pad 4 dressed by the dresser 3 is measured by the eddy-current sensor 10. Alternatively, the cutting rate may be measured by detecting a change in torque current of the motor 7 which drives (rotates) the polishing table 1, or a change in torque current of the motor 14 which drives (rotates) the dresser 3, or a change in vertical position of a contact surface of the dresser 3 contacting the polishing pad 4, or a combination of these changes. The change in vertical position of the contact surface of the dresser 3 can be detected by measuring a change in vertical position of the dresser 3. As described above, the radial position of the dresser 3 on the upper surface of the polishing pad 4 is detected by the pulse number supplied to the motor 29 (e.g., a position control motor or a pulse motor). However, any type of device or means can be used as long as it can detect the radial position of the dresser 3 on the upper surface of the polishing pad 4.

In the polishing apparatus as described above, because individual dressers have different properties, replacement of the dresser 3 with a new dresser can result in a change in cutting degree (i.e., a cutting rate) of the polishing pad 4, causing a change in removal rate and polishing profile of a film on a substrate. After the dresser 3 is replaced with a new dresser, preconditioning of the new dresser is usually performed by pressing the new dresser against the polishing pad 4 at given pressure. This preconditioning process is, however, problematic because it may adversely affect the polishing performance, particularly at an initial stage of polishing of the substrate W. Thus, in this embodiment, the polishing apparatus has a dresser-preconditioning device 20 configured to perform preconditioning of a new dresser 3 after the previous dresser is replaced with the new dresser 3, as shown in FIG. 3. The dresser-preconditioning device 20 is disposed in an idling position of the dresser 3, i.e., in a position at an end of a swinging range of the dresser 3 outside of the upper surface of the polishing pad 4.

Figure 4A:
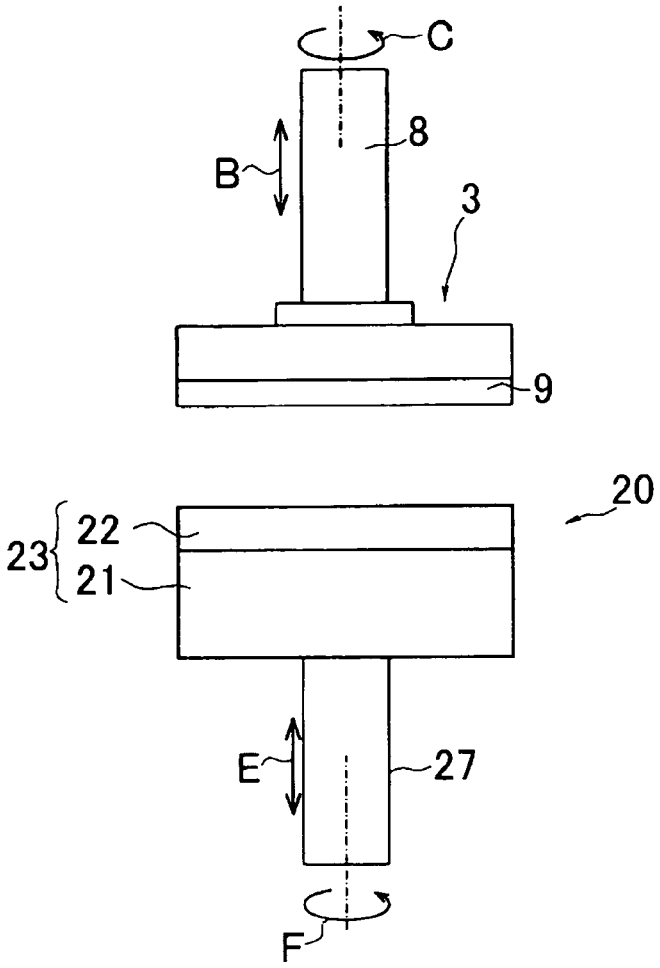
FIG. 4A is a schematic side view showing an example of a dresser-preconditioning device of the dressing apparatus according to the embodiment of the present invention.
Figure 4B:
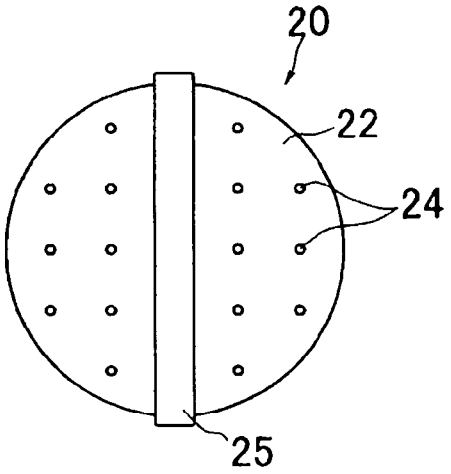
FIG. 4B is a schematic plan view of the dresser-preconditioning device.

FIG. 4A is a side view showing the dresser-preconditioning device 20, and FIG. 4B is a plan view showing the dresser-preconditioning device 20. As shown in FIGS. 4A and 4B, the dresser-preconditioning device 20 has a dresser-preconditioning section 23 including a base 21 and a dresser-preconditioning member 22 attached to an upper surface of the base 21. The dresser-preconditioning section 23 is supported by a support shaft 27. The dresser-preconditioning section 23 is vertically movable in directions indicated by arrow E by a vertically moving mechanism (not shown in the drawing), and is rotatable about its own axis in a direction indicated by arrow F by a motor (not shown in the drawing). The dresser-preconditioning member 22 is made of the same material as the polishing pad 4, e.g., foamed polyurethane. The dresser-preconditioning member 22 has a number of cleaning liquid ejecting holes 24 which are open upwardly for ejecting a cleaning liquid that is to be supplied through a cleaning liquid supply passage (not shown in the drawing) provided in the base 21. A radially-extending dresser cleaning brush 25, such as a nylon brush, may be attached to the dresser-preconditioning section 23 in such a position that the dresser cleaning brush 25 passes through a center of the dresser-preconditioning member 22.

Figure 5:
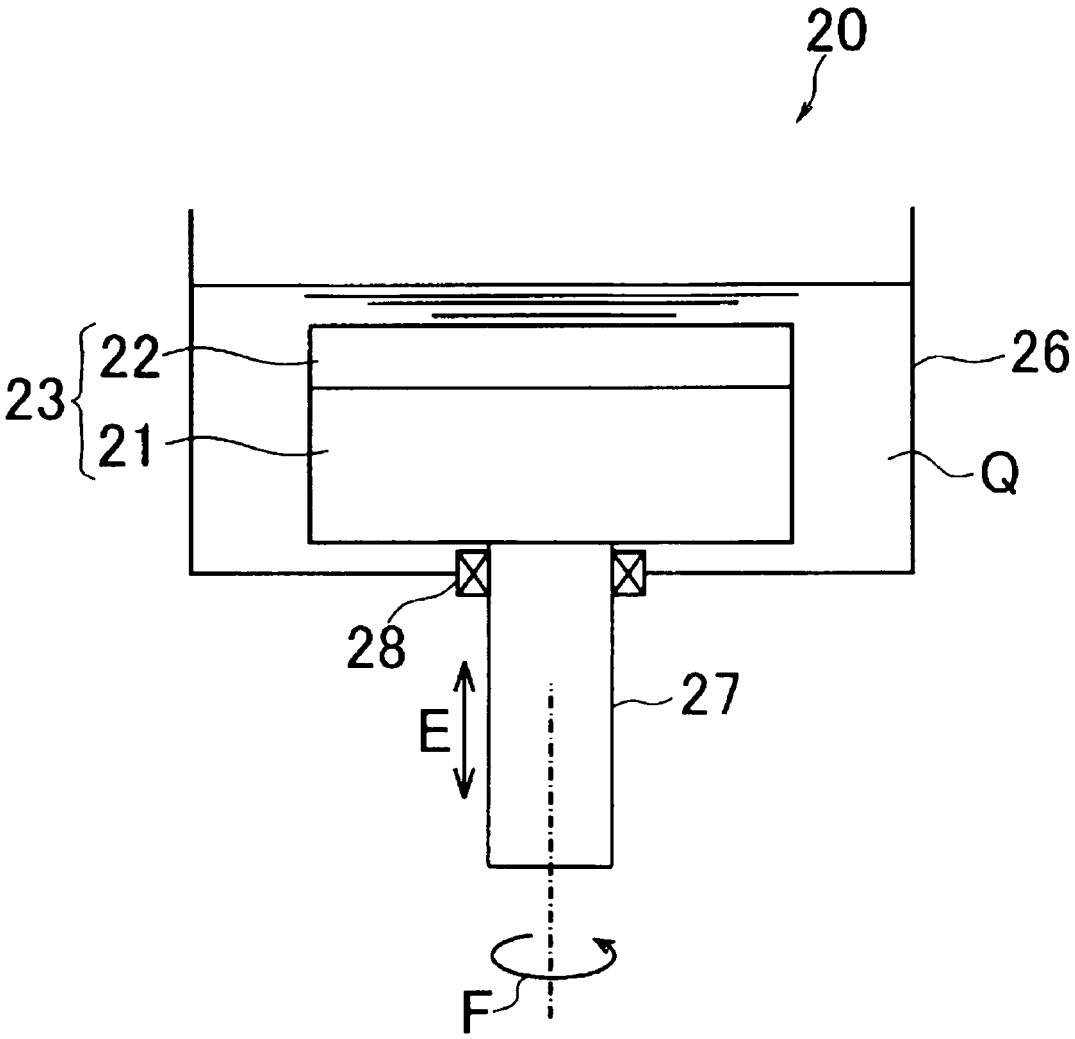
FIG. 5 is a cross-sectional view showing the dresser-preconditioning device in a normal state according to the embodiment of the present invention.
Figure 6:
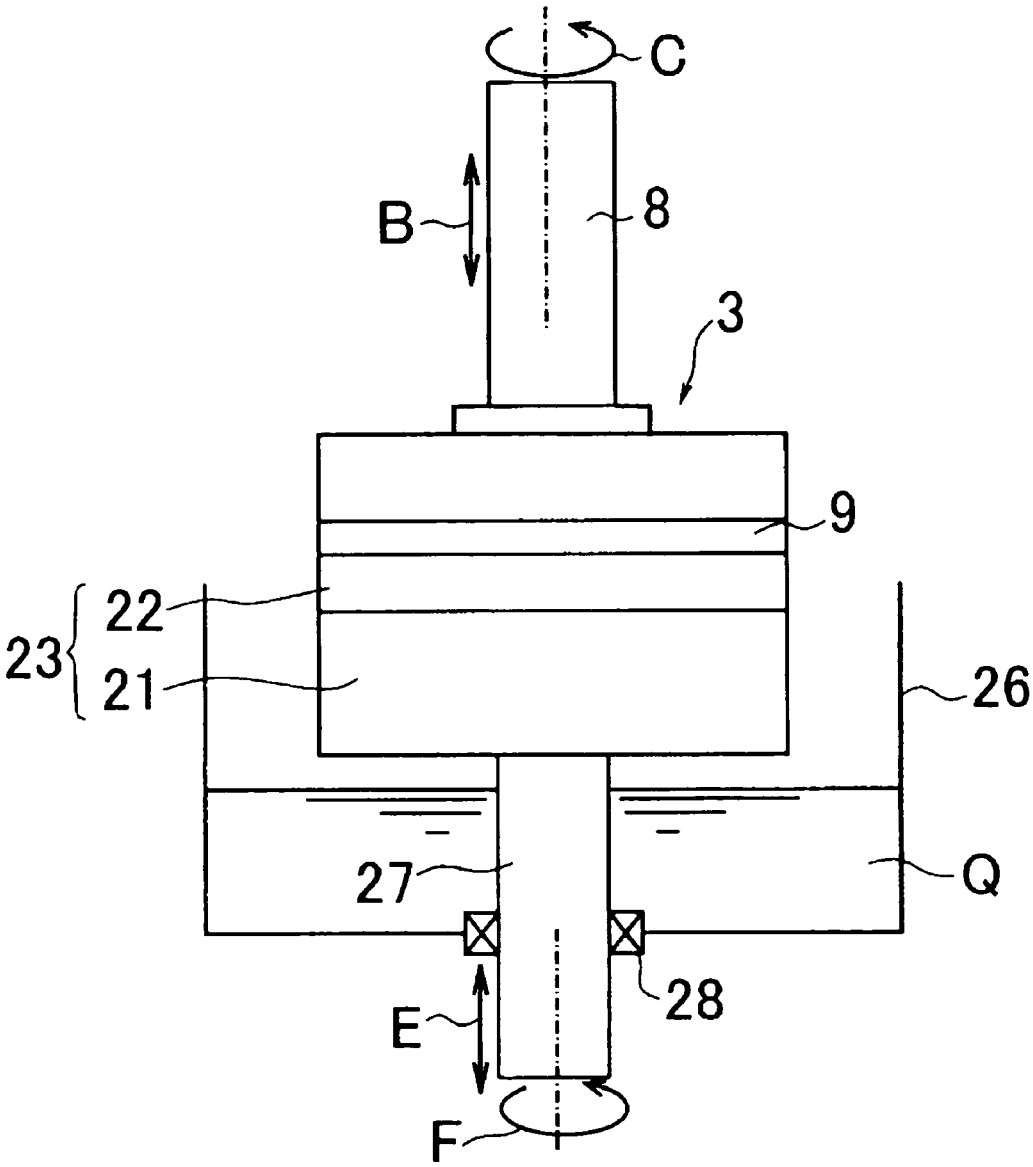
FIG. 6 is a cross-sectional view showing the dresser-preconditioning device when preconditioning the dresser according to the embodiment of the present invention.

Normally, as shown in FIG. 5, the dresser-preconditioning section 23 is immersed in a cleaning liquid Q in a cleaning liquid tank 26 so as to be kept wet. A seal mechanism 28 is disposed around the support shaft 27 so as to prevent the cleaning liquid Q from leaking out of the cleaning liquid tank 26. After the used dresser is replaced with the new dresser 3, the dresser-preconditioning section 23 is elevated toward the new dresser 3 that is in a predetermined idling position right above the dresser-preconditioning section 23, and presses the lower surface of the dresser 3 at predetermined pressure, as shown in FIG. 6. In this state, the dresser-preconditioning section 23 is rotated about its own axis in the direction indicated by arrow F, and simultaneously the dresser 3 is rotated about its own axis in the direction indicated by the arrow C to cause relative motion between the dresser-preconditioning section 23 and the dresser 3. As a result of this relative motion, the dresser 3 is preconditioned, while the upper surface of the dresser-preconditioning member 22 is scraped off by the dresser 3. Pressure applied by the dresser-preconditioning section 23 and a rotational speed of the dresser-preconditioning section 23 are controlled by a controller (not shown in the drawing). Instead of rotating both the dresser 3 and the dresser-preconditioning section 23, the dresser-preconditioning section 23 may remain stationary.

The dresser-preconditioning device 20 has an eddy-current sensor (not shown in the drawing) provided in the base 21 of the dresser-preconditioning section 23. This eddy-current sensor is identical to the eddy-current sensor 10 shown in FIG. 2, and is used to measure a change in thickness of the dresser-preconditioning member 22 and to measure a cutting rate of the dresser-preconditioning member 22. This cutting rate measured and a cutting rate obtained in advance when the dresser 3 is in a normal condition are compared with each other. If the cutting rate measured is normal, then it is judged that the preconditioning process has reached a preconditioning end point, and the preconditioning process is terminated. If the cutting rate measured is not normal, then the dresser-preconditioning section 23 continues preconditioning the dresser 3 so as to adjust the cutting rate.

Generally, the cutting rate of the polishing pad 4 by the dresser 3 is gradually decreased throughout a service life of the dresser 3 in accordance with wear of angular potions of the diamond grains. However, a brand-new dresser tends to exhibit a rapid decrease in cutting rate of the polishing pad 4 at an initial stage of its service life, and the decrease in cutting rate becomes less steep at a certain time. Therefore, it is possible to determine the end point of preconditioning of the dresser 3 by detecting such a time point when the decrease in cutting rate becomes less steep.

The cutting rate of the dresser-preconditioning member 22 can be measured from the torque current of the motor 14 (see FIG. 2) which drives the dresser 3, or a torque current of the motor (not shown in the drawing) which drives the dresser-preconditioning section 23, or a combination of these torque current values. Alternatively, a dresser vertical position sensor (not shown in the drawing) may be provided for measuring a vertical position of the dresser 3 during dressing, so that the cutting rate of the dresser-preconditioning member 22 can be measured based on an output signal from this dresser vertical position sensor.

Figure 7:
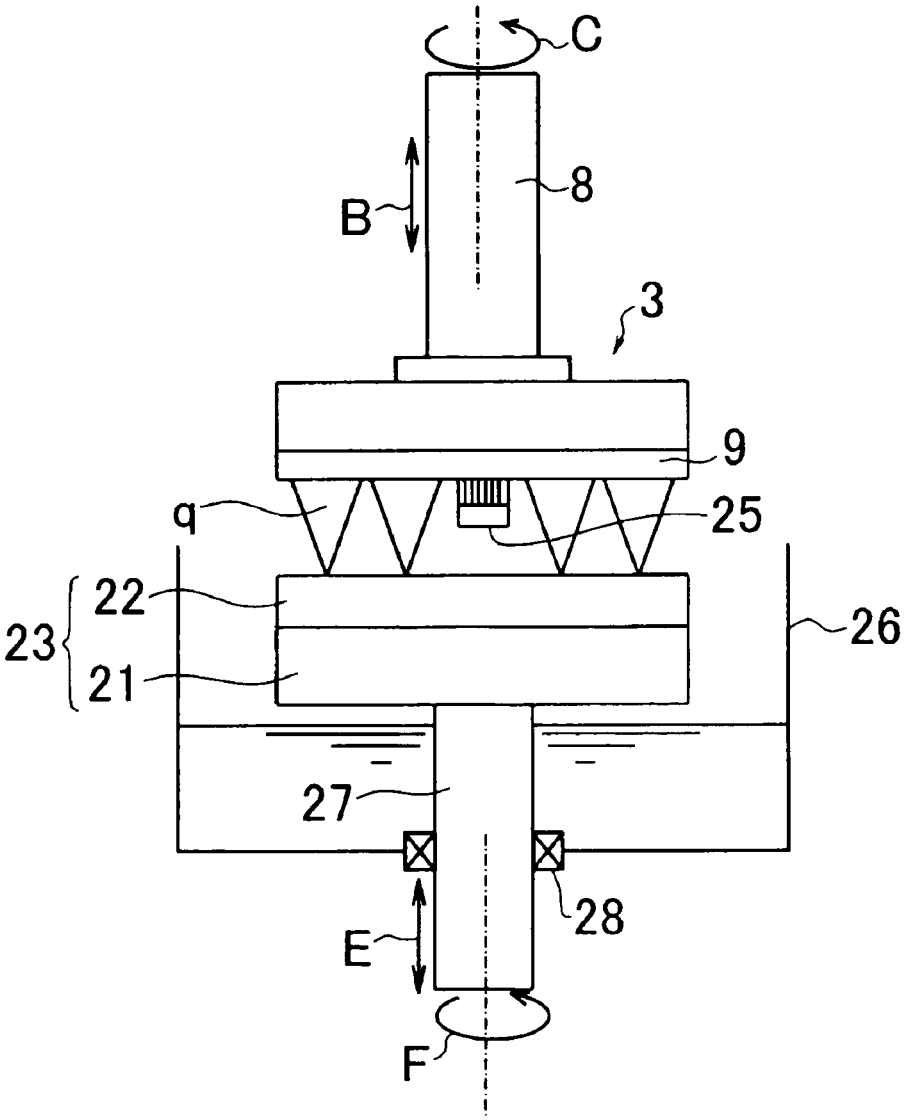
FIG. 7 is a cross-sectional view showing the dresser-preconditioning device when cleaning the dresser according to the embodiment of the present invention.

After the preconditioning process of the dresser 3 is terminated, at least one of the dresser 3 and the dresser-preconditioning section 23 is moved in a direction away from each other so as to form a gap between the lower surface of the dresser 3 and the upper surface of the dresser-preconditioning member 22, as shown in FIG. 7. Then, the dresser cleaning brush 25 is brought into contact with the lower surface of the metal layer 9 that firmly holds the diamond particles. In this state, a cleaning liquid q (e.g., pure water, a chemical solution, or a mixture of pure water, a chemical solution, and a $N_2$ gas) is ejected from the cleaning liquid ejecting holes 24 of the dresser-preconditioning member 22 toward the metal layer 9 to thereby clean the lower surface of the metal layer 9. In this manner, deposits, such as the slurry, are removed from the lower surface of the metal layer 9.

Figure 8:
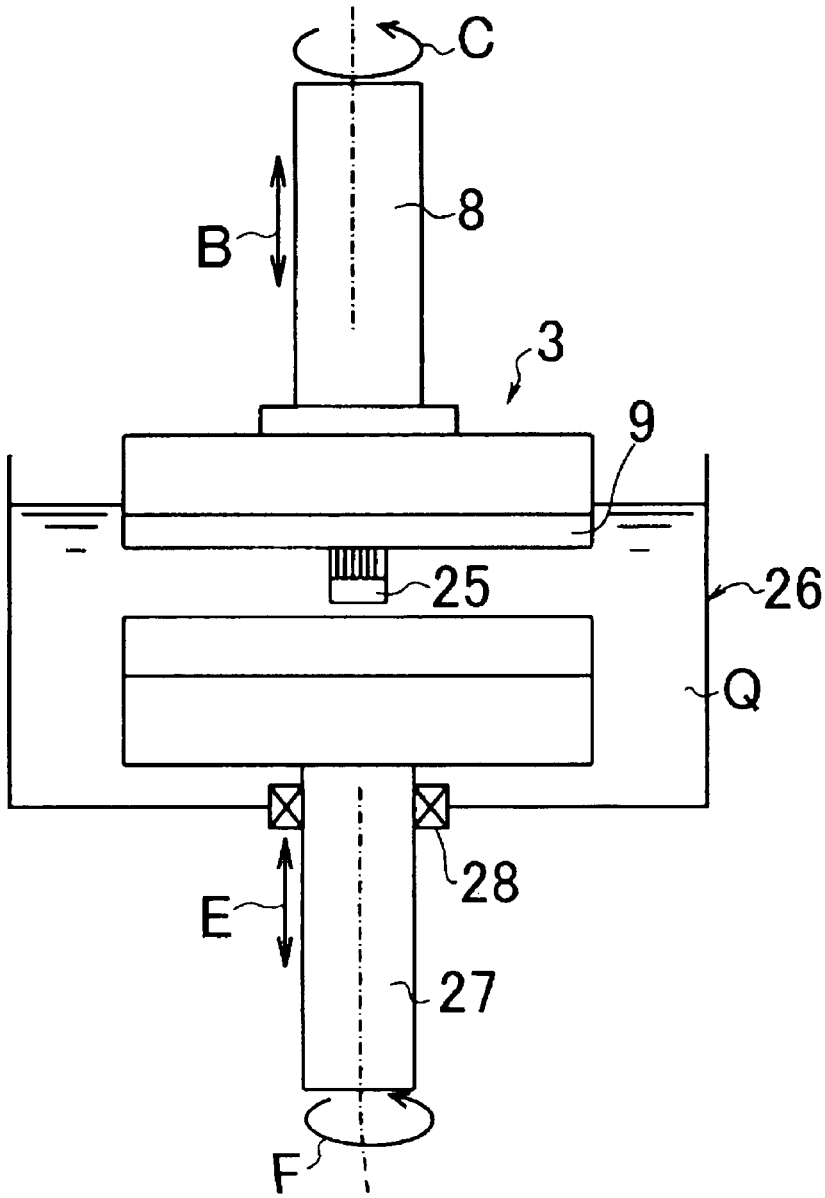
FIG. 8 is a cross-sectional view showing the dresser-preconditioning device in a waiting state according to the embodiment of the present invention.

After the preconditioning process and the cleaning process are finished and while the polishing apparatus is polishing a substrate, the lower surface of the metal layer 9 is immersed in the cleaning liquid Q in the cleaning liquid tank 26 as shown in FIG. 8. In this idling position, the dresser 3 is rotated about its own axis with the lower surface of the metal layer 9 being in contact with the dresser cleaning brush 25, so that the lower surface of the metal layer 9 is kept wet and clean. The lower surface of the dresser 3 is thus kept wet and clean.

The dresser 3, which has been used to dress the polishing pad 4 for a long period of time, has a lowered cutting rate. When the cutting rate is lowered to a predetermined level, it is judged that the service life of the dresser 3 has expired, and then the dresser 3 is replaced with a new dresser. The dresser-preconditioning device 20 may be used to determine whether or not the service life of the dresser 3 has expired. Specifically, the dresser-preconditioning device 20 may have a dresser service life determining section for determining the end of the service life of the dresser 3 based on the cutting rate of the dresser-preconditioning member 22. To determine the end of the service life of the dresser 3 that has been used to dress the polishing pad 4, the dresser 3 is placed on the dresser-preconditioning device 20, and dresses the dresser-preconditioning member 22. The dresser service life determining section measures the cutting rate of the dresser-preconditioning member 22, and determines whether the service life of the dresser 3 has expired based on the cutting rate measured.

During the preconditioning process of the newly replaced dresser 3 performed by the dresser-preconditioning device 20, the torque current of the motor 14, which drives the dresser 3, changes as the preconditioning process progresses. For example, the torque current of the motor 14 gradually decreases during the preconditioning process, and becomes constant when the preconditioning process approaches its end point. Therefore, it is possible to monitor the torque current of the motor 14 so as to detect the preconditioning end point of the dresser 3.

The upper surface of the polishing pad 4 on the polishing table 1 is dressed by the dresser 3 each time polishing of one substrate is terminated. During dressing, the rotating dresser 3 presses the upper surface of the polishing pad 4 on the rotating polishing table 1 at predetermined pressure. More specifically, as shown in FIG. 3, while pressing its dressing surface against the upper surface of the polishing pad 4, the dresser 3 repetitively oscillates or swings around the central axis O in the radial directions of the polishing pad 4 as indicated by the arrow D. One dressing process of the polishing pad 4 is performed by a plurality of swinging motions (i.e., repetitive swinging motions) of the rotating dresser 3 on the polishing pad 4. Measuring of a profile (a shape of the upper surface) of the dressed polishing pad 4 is performed by measuring the thickness (i.e., the height of the upper surface) of the polishing pad 4 at predetermined points "a" to "e" in plural zones arranged along the radial direction on the upper surface of the polishing pad 4, as shown in FIG. 9.

If the thickness of the polishing pad 4 at the five points "a" to "e" is to be measured successively in one swinging motion of the dresser 3, high-speed data processing will be required. Hence, an expensive data processor capable of performing such high-speed data processing will be required. Thus, in this embodiment, the thickness of the polishing pad 4 is measured at only one of the points "a" to "e" during one dressing process. In other words, the thickness of the polishing pad 4 at one predetermined point in one of the plural zones is measured each time the dresser 3 performs one dressing process. For example, the thickness of the polishing pad 4 is measured at the point "a" in a first dressing process, at the point "b" in a second dressing process, at the point "c" in a third dressing process, at the point "d" in a fourth dressing process, and at the point "e" in a fifth dressing process. In this manner, the thickness of the polishing pad 4 is measured at all the points "a" to "e" through the plural dressing processes (in this example, five dressing processes for the points "a" to "e"). In order to prevent an adverse effect of noise on the measurements, the thickness of the polishing pad 4 is measured plural times at each of the points "a" to "e", and an average of measurements at each of the points "a" to "e" is calculated. This average calculated is used as a thickness of the polishing pad 4 at each point. For example, in FIG. 9, the thickness of the polishing pad 4 at the point "a" is measured several times, and the average of the measurements is used as a thickness at the point "a". The thickness of the polishing pad 4 at the point "b" is measured several times, and the average of the measurements is used as a thickness at the point "b". The thickness of the polishing pad 4 at the other points "c" to "e" is measured in the same manner.

As described above, measuring of the thickness of the polishing pad 4 is repeated until the measurements of the thickness at all the predetermined points in the plural zones are obtained. Therefore, after plural substrates are polished and the polishing pad 4 is dressed several times, a profile of the polishing pad 4 is measured (or determined) from the measurements. A set of these measuring steps is repeated several times, so that an average profile is calculated from the measurements of the thickness. The resultant average profile is used as a profile of the polishing pad 4, which is reflected in a polishing recipe. In the example shown in FIG. 9, while five substrates are polished and the polishing pad 4 is dressed five times, the thickness of the polishing pad 4 at the points "a" to "e" is measured, whereby one profile of the polishing pad 4 is obtained. This set of measuring steps is repeated three times, (i.e., fifteen substrates are polished), so that an average profile, calculated from the measurements, is used as a profile of the polishing pad 4, which is reflected in a polishing recipe.

Figure 10:
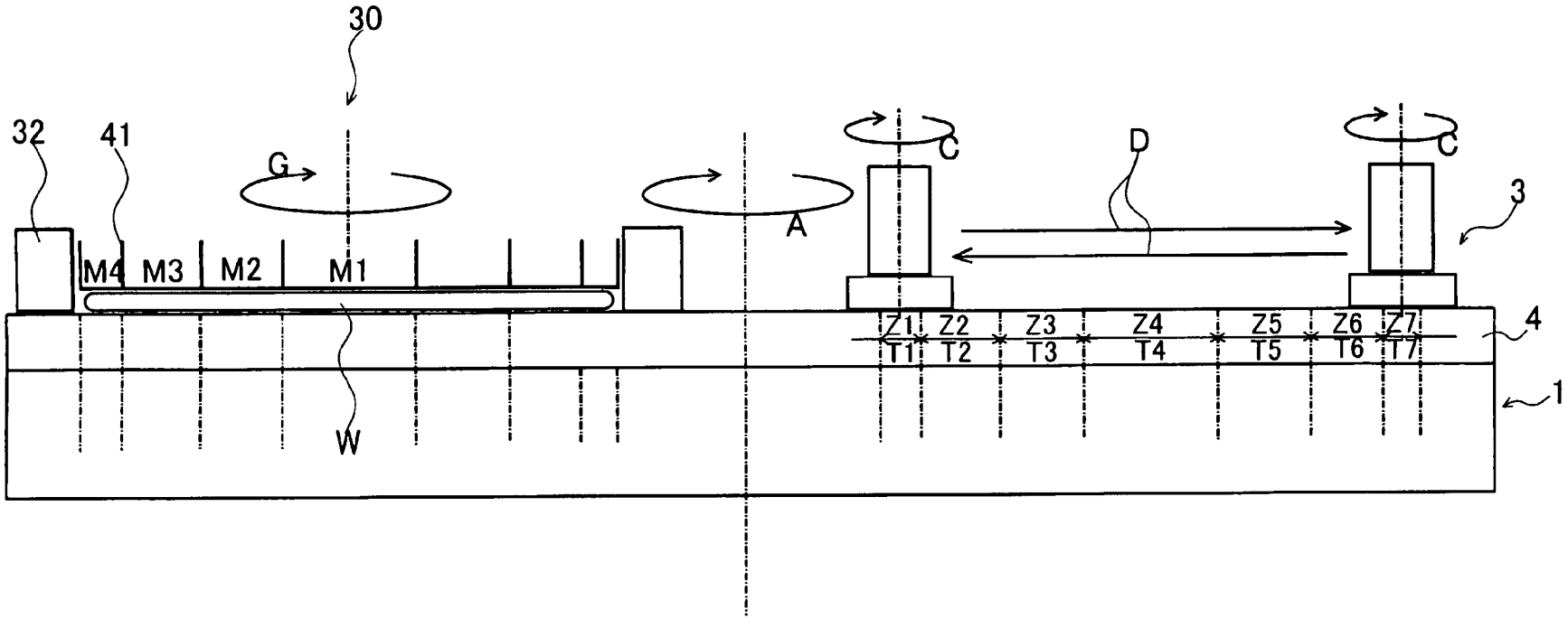
FIG. 10 is a schematic view of a substrate polishing apparatus according to the embodiment of the present invention.

FIG. 10 is a schematic view of a substrate polishing apparatus according to the embodiment of the present invention. Dressing of the polishing pad 4 is performed as follows. The polishing table 1 is rotated in the direction indicated by the arrow A and the dresser 3 is rotated in the direction indicated by the arrow C. The dresser 3 presses the upper surface of the polishing pad 4, attached on the upper surface of the polishing table 1, at a predetermined force. In this state, the dresser 3 is reciprocated in the radial directions of the polishing pad 4 as indicated by the arrows D by the swinging motion of the dresser arm 2 (see FIG. 3) to thereby dress the polishing pad 4. The upper surface of the polishing pad 4 is divided into annular zones Z1 to Z7 arranged along the radial direction of the polishing pad 4. During dressing, positions of the dresser 3 when it is on central portions of the zones Z1 to Z7 are detected by the pulse number supplied to the motor 29 which is the position control motor or the pulse motor, so that the thickness of the polishing pad 4 is measured at the central portions of the zones Z1 to Z7. The radial positions of the dresser 3 on the upper surface of the polishing pad 4 can be accurately detected by the pulse number supplied to the motor 29. In FIG. 10, symbols T1 to T7 represent measurements of the thickness of the polishing pad 4 at the central portions of the respective zones Z1 to Z7.

A dressing profile of the polishing pad 4 is measured from the measurements T1 to T7 of the thickness of the polishing pad 4 in the zones Z1 to Z7. The profile is fed back to the dresser operation controller, where the profile is reflected in the dressing conditions (e.g., the pressing force applied to the polishing pad 4 by the dresser 3, the moving speed of the dresser 3 in the radial directions on the upper surface of the polishing pad 4, and the rotational speed of the dresser 3). As a result, an ideal dressing profile of the polishing pad 4 can be obtained.

Reference numeral 30 represents a top ring configured to hold a substrate W on a lower surface thereof and to rotate the substrate W about a rotational axis (not shown) in a direction indicated by arrow G. This top ring 30 has a retainer ring 32 on a lower peripheral edge thereof. Annular pressure chambers M1 to M4 are provided inside the retainer ring 32. These pressure chambers M1 to M4 are formed by a membrane 41. This membrane 41 has a lower surface that provides a holding surface for holding the substrate W. By adjusting pressures in the pressure chambers M1 to M4, the pressing forces applied to the polishing pad 4 via the substrate W that contacts the pressure chambers can be controlled.

Pressure controllers are provided in fluid passages, respectively, which are in fluid communication with the respective pressure chambers M1 to M4. These pressure controllers are controlled based on the measurements T1 to T7 representing the thickness of the polishing pad 4 at the respective zones Z1 to Z7, so that the pressures in the pressure chambers M1 to M4 formed by the membrane 41 are adjusted. With these operations, the pressure chambers M1 to M4 can provide a pressure distribution that accords to the thickness of the polishing pad 4. Therefore, without being affected by the dressing profile of the polishing pad 4, an appropriate polishing profile (or removal profile) of the film on the substrate W can be realized. In an example, pressure in the pressure chamber corresponding to the zone (region) with a small measurement of the thickness of the polishing pad 4 is selectively adjusted to be higher than pressures in the other pressure chambers corresponding to the zones (regions) with large measurements, so that a polishing rate (removal rate) of the film on the substrate W can be rendered uniform over the surface thereof. However, the present invention is not limited to this manner of pressure adjustment. In essence, feedback control is performed such that the pressing force in each zone is adjusted in accordance with the profile of the polishing pad 4 so as to realize a desired polishing profile. When polishing substrates successively, the pad profile changes with time. Thus, this change in pad profile may be incorporated into consideration variables for controlling the pressing forces.

The pressure in the pressure chamber corresponding to the zone (region) with a small measurement of the thickness of the polishing pad 4 is selectively adjusted to be higher than the pressures in the other pressure chambers corresponding to the zones (regions) with large measurements. Further, the dressing profile of the polishing pad 4 is fed back to the dresser operation controller, so that an ideal dressing profile of the polishing pad 4 is obtained. Based on this ideal dressing profile of the polishing pad 4 obtained, the pressures in the pressure chambers M1 to M4 are adjusted. Therefore, a more appropriate polishing profile of the film on the substrate W can be realized.

Figure 11:
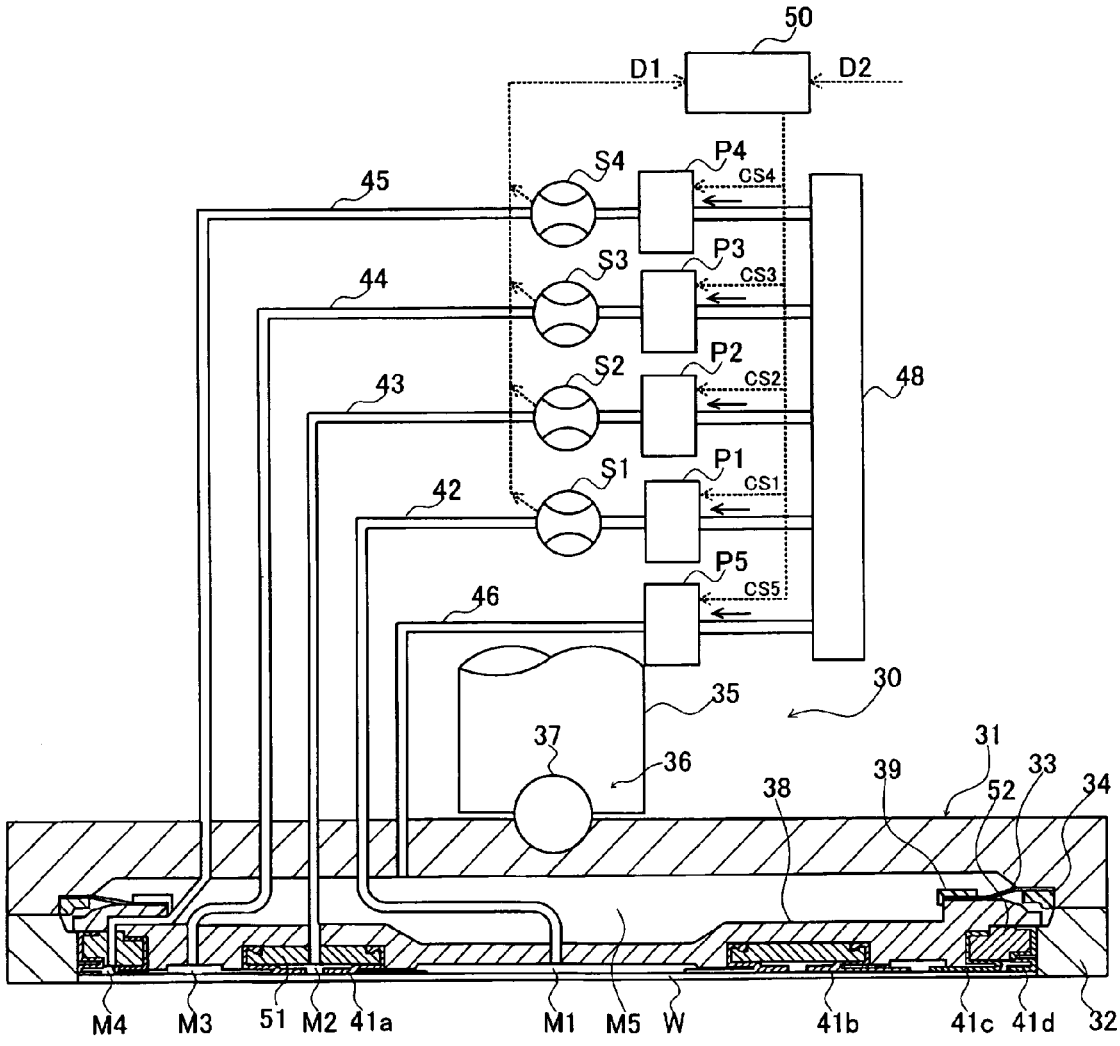
FIG. 11 is a vertical cross-sectional view showing a schematic structure of the top ring used in the substrate polishing apparatus according to the embodiment of the present invention.

FIG. 11 is a vertical cross-sectional view showing a schematic structure of the top ring used in the substrate polishing apparatus according to the embodiment of the present invention. The top ring 30 includes a top ring body 31 in a shape of cylindrical vessel, and the retainer ring 32 secured to a lower end portion of the top ring body 31. An annular pressure sheet 33 is provided inside the top ring body 31. This pressure sheet 33 is interposed between the top ring body 31 and a pressure-sheet supporting member 34 and is supported by an inner circumferential lower surface of the top ring body 31. A top ring drive shaft 35 is arranged above a center of an upper surface of the top ring body 31. The top ring body 31 and the top ring drive shaft 35 are coupled to each other via a universal coupling 36. This universal coupling 36 includes a spherical bearing mechanism having a bearing ball 37 which allows the top ring body 31 and the top ring drive shaft 35 to tilt with respect to each other, and a non-illustrated rotation transmission mechanism which transmits rotation of the top ring drive shaft 35 to the top ring body 31. The top ring body 31 is tiltable with respect to the top ring drive shaft 35, and is rotated by receiving the rotation of the top ring drive shaft 35.

A disk-shaped chucking plate 38 is provided in an inner space defined by the top ring body 31 and the retainer ring 32. This chucking plate 38 is held on a lower surface of the pressure sheet 33 via a chucking-plate holding member 39. The top ring body 31, the pressure sheet 33, and the chucking plate 38 define a pressure chamber MS on the chucking plate 38. The pressure sheet 33 is made of an elastic material such as rubber. As pressure in the pressure chamber M5 is increased or decreased, the chucking plate 38 is lowered or elevated. The chucking plate 38 has a lower surface that provides a holding surface for holding the substrate W.

Annular membranes 41*a*, 41*b*, 41*c*, and 41*d* are arranged on the lower surface of the chucking plate 38. The membrane 41*a* has an upper edge interposed between the chucking plate 38 and an annular membrane holder 51, so that the membrane 41*a* is mounted on a central portion of the lower surface of the chucking plate 38. The membrane 41*b* has an upper edge interposed between the chucking plate 38 and the annular membrane holder 51, so that the membrane 41*b* is mounted on the lower surface of the chucking plate 38. This membrane 41*b* is arranged around the membrane 41*a*. The membranes 41*c* and 41*d* has upper edges interposed between the chucking plate 38 and an annular membrane holder 52, so that the membranes 41*c* and 41*d* are mounted on a peripheral portion of the lower surface of the chucking plate 38. The membrane 41*c* is arranged around the membrane 41*b*, and the membrane 41*d* is arranged around the membrane 41*c*. The pressure chambers M1, M2, M3, and M4 are formed by the membranes 41*a*, 41*b*, 41*c*, and 41*d*, the substrate W, and the chucking plate 38.

Fluid passages 42, 43, 44, and 45 are connected to the pressure chambers M1, M2, M3, and M4, respectively. These fluid passages 42, 43, 44, and 45 are in fluid communication with a compressed air source 48 via pressure controllers P1, P2, P3, and P4. A fluid passage 46 is connected to the pressure chamber M5, and this fluid passage 46 is also coupled to the compressed air source 48 via a pressure controller P5. In FIG. 11, symbols S1, S2, S3, and S4 represent sensors each for measuring a velocity, pressure, and a flow rate of a fluid (compressed air) flowing through each of the fluid passages 42, 43, 44, and 45.

In the top ring 30 as described above, the pressure controller P5 is operated to control the pressure of the air that is to be supplied from the compressed air source 48 to the pressure chamber M5 through the fluid passage 46 so as to control the pressing force on the substrate W in its entirety against the upper surface of the polishing pad 4. Further, the pressure controllers P1, P2, P3, and P4 are operated to control the pressures of the air that is to be supplied from the compressed air source 48 to the pressure chambers M1, M2, M3, and M4 through the fluid passages 42, 43, 44, and 45 so as to control the pressing forces on the zones (regions) of the substrate W located below the pressure chambers M1, M2, M3, and M4.

The velocity, the pressure, and the flow rate of the fluid (compressed air) flowing through the fluid passages 42, 43, 44, and 45 are measured by the sensors S1, S2, S3, and S4, and these measurement data D1 are sent to a controller 50. Several types of data D2 including polishing profiles required for polishing the substrate W and polishing pad profiles measured are stored in the controller 50. This controller 50 is configured to calculate the pressures to be developed in the pressure chambers M1, M2, M3, M4, and M5 during polishing of the substrate W for achieving a target polishing profile, from the data D2 and the measurement data D1. Further, the controller 50 is configured to calculate the velocities, the pressures, and the flow rates of the compressed air to be supplied to the pressure chambers, and send control signals CS1, CS2, CS3, CS4, and CS5 to the pressure controllers P1, P2, P3, P4, and P5 so as to control the velocities, the pressures, and the flow rates of the compressed air to be supplied to the pressure chambers M1, M2, M3, M4, and M5 via the pressure controllers P1, P2, P3, P4, and P5.

Figure 12:
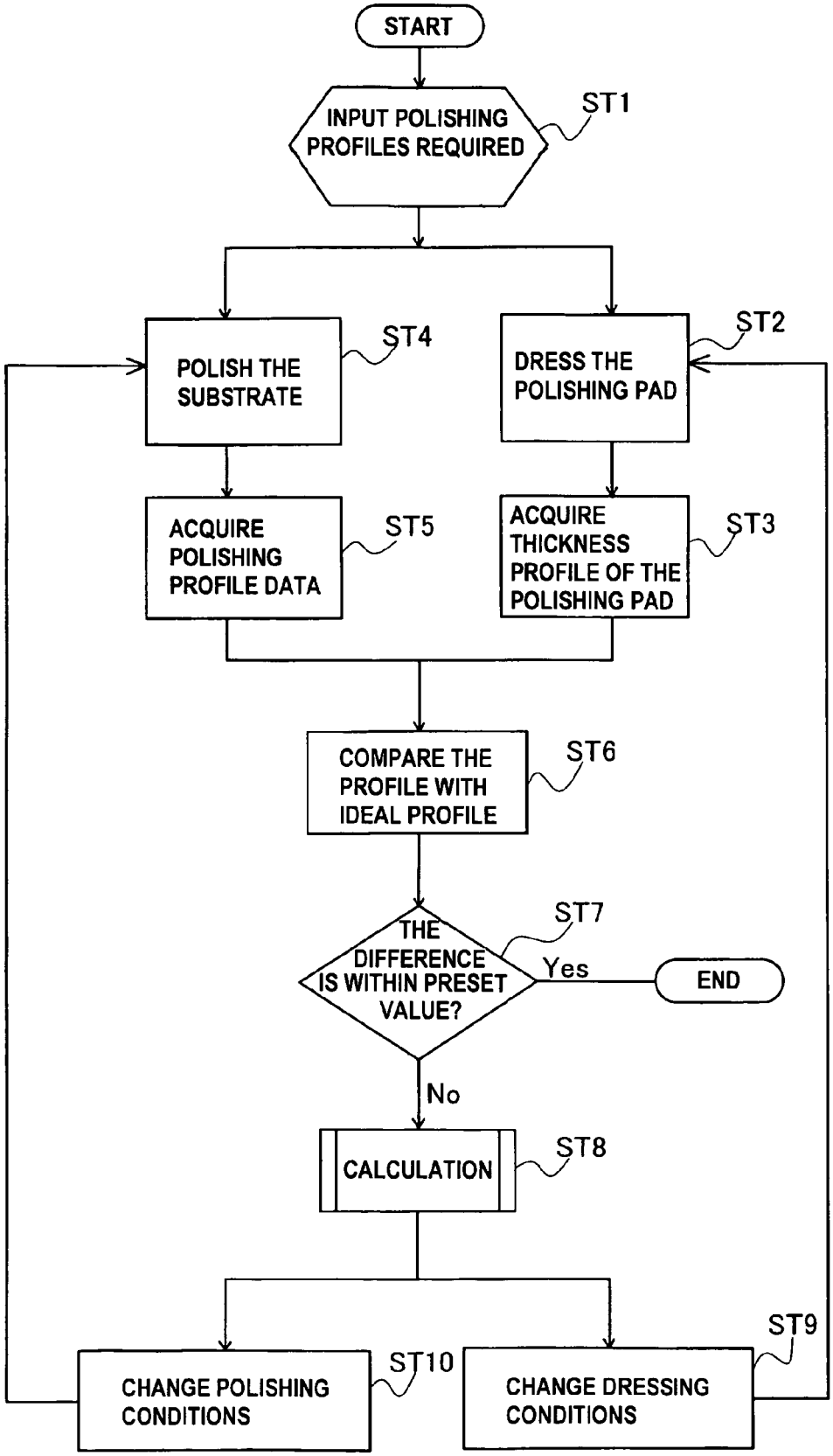
FIG. 12 is a diagram showing a process flow for reflecting a dressing profile of a polishing pad in a polishing process of a substrate.

FIG. 12 is a diagram showing a process flow for reflecting the dressing profile of the polishing pad, measured as described above, in a polishing process of a substrate. Necessary polishing profiles of the film on the substrate are inputted to the controller 50 (step ST1). Then, dressing of the polishing pad 4 is performed (step ST2). The thickness of the polishing pad 4 is measured at the respective zones, so that a thickness profile of the polishing pad 4 is obtained, i.e., measured (step ST3). On the other hand, polishing of the substrate W is performed (step ST4), a polishing rate of the film on the substrate W is measured, and a polishing profile data is obtained (step ST5).

The thickness profile of the polishing pad 4 obtained in the step ST3 and an ideal thickness profile of the polishing pad 4 are compared, and the polishing profile obtained in the step ST5 and an ideal polishing profile are compared (step ST6). Next, from the results of the comparison in the step ST6, it is judged whether or not a difference between the profile obtained and the ideal profile is within a preset value. When the difference is within the preset value (i.e., "YES"), the process flow is terminated. On the other hand, when the difference is beyond the preset value (i.e., "NO"), calculations are conducted for changing the dressing conditions and the polishing conditions (step ST8).

Based on the above-described calculation results, the dressing conditions (e.g., the pressing forces of the dresser 3 exerted on the respective zones Z1 to Z7 in the upper surface of the polishing pad 4, the rotational speed of the dresser 3, the moving speed of the dresser 3 in the directions indicated by the arrows D) are changed (step ST9), and polishing of a substrate is performed. In this manner, the change in dressing conditions is fed back to the dresser operation controller. In addition, based on the above-described calculation results, the polishing conditions (e.g., the pressures in the pressure chambers M1 to M4) are changed (step ST10), and polishing of a substrate is performed. In this manner, the change in polishing conditions is fed back to a top ring operation controller for controlling an operation of the top ring 30.

While a certain preferred embodiment of the present invention has been shown and described in detail, it should be understood that various changes and modifications can be made therein without departing from the scope of the appended claims.

What is claimed is:

1. A dressing apparatus for dressing a polishing pad on a polishing table, said dressing apparatus comprising:

a dresser configured to dress the polishing pad by pressing the polishing pad under a predetermined dressing condition;

a dresser operation controller configured to control an operation of said dresser and establish the predetermined dressing condition; and a cutting rate measuring section configured to measure a cutting rate of the polishing pad and feed back the cutting rate measured to said dresser operation controller, wherein said dresser operation controller is configured to reflect the cutting rate in the predetermined dressing condition, and wherein said cutting rate measuring section is configured to measure the cutting rate by detecting a change in vertical position of a contact surface of said dresser when contacting the polishing pad.

2. A dressing apparatus for dressing a polishing pad on a polishing table, said dressing apparatus comprising:

a dresser configured to dress the polishing pad by pressing an upper surface of the polishing pad, said dresser being operable to swing in a predetermined range including the upper surface of the polishing pad; and a dresser-preconditioning device including a dresser-preconditioning member and a thickness measuring device configured to measure a change in thickness of said dresser-preconditioning member, said dresser-preconditioning device being configured to precondition said dresser by pressing said dresser-preconditioning member against a lower surface of said dresser and providing relative motion between said dresser-preconditioning member and said dresser to allow said dresser to scrape off a surface of said dresser-preconditioning member, said dresser-preconditioning device being provided at a portion of the predetermined range outside of the upper surface of the polishing pad.

3. The dressing apparatus according to claim 2, wherein said dresser-preconditioning device further includes a cutting rate measuring device configured to measure a cutting rate of the polishing pad.

4. The dressing apparatus according to claim 3, further comprising:

a service life determining device configured to determine a service life of said dresser based on the cutting rate measured by said cutting rate measuring device.

5. The dressing apparatus according to claim 2, wherein said dresser-preconditioning device further includes a torque current measuring section configured to measure a torque current of a motor which drives said dresser, and an end point detector configured to detect an end point of preconditioning of said dresser, based on the torque current measured by said torque current measuring section.

6. The dressing apparatus according to claim 2, further comprising:

a cleaning device configured to clean a dressing surface of said dresser while said dresser is being preconditioned by said dresser-preconditioning device.

7. The dressing apparatus according to claim 2, wherein said dresser-preconditioning device further includes a torque current measuring section configured to measure a torque current of a motor which drives said dresser-preconditioning member, and an end point detector configured to detect an end point of preconditioning of said dresser based on the torque current measured by said torque current measuring section.

8. The dressing apparatus according to claim 2, wherein said thickness measuring device comprises an eddy-current sensor configured to measure a change in thickness of said dresser-preconditioning member, and said dresser-preconditioning device further includes an end point detector configured to detect an end point of preconditioning of said dresser based on the change in thickness of said dresser-preconditioning member measured by said eddy-current sensor.

9. A dressing apparatus for dressing a polishing pad on a polishing table, said dressing apparatus comprising:

a dresser configured to rotate about its own axis and dress the polishing pad by pressing an upper surface of the polishing pad at a predetermined force, said dresser being coupled to a dresser arm;

a dresser swinging mechanism configured to cause said dresser to swing on the upper surface of the polishing pad in radial directions of the polishing pad;

a dresser position measuring device configured to measure a radial position of said dresser on the upper surface of the polishing pad;

a cutting rate measuring device configured to measure a cutting rate of the polishing pad dressed by said dresser;

a polishing pad profile measuring device configured to obtain a profile of the polishing pad from the cutting rate of the polishing pad measured at plural zones defined in the upper surface of the polishing pad, positions of the plural zones being measured by said dresser position measuring device; and a dresser operation controller configured to control an operation of said dresser, wherein the profile of the polishing pad measured by said polishing pad profile measuring device is fed back to said dresser operation controller.

10. The dressing apparatus according to claim 9, wherein:

said dresser swinging mechanism includes a motor as a drive source for swinging said dresser arm; and said dresser position measuring device is configured to measure the radial position of said dresser from a pulse number supplied to said motor.

11. A substrate polishing apparatus comprising:

a polishing table for supporting a polishing pad;

a top ring configured to rotate a substrate and press the substrate against the polishing pad at a predetermined force while rotating the substrate;

a top ring operation controller configured to control an operation of said top ring;

a dresser configured to rotate about its own axis and dress the polishing pad by pressing an upper surface of the polishing pad at a predetermined force, said dresser being coupled to a dresser arm;

a dresser swinging mechanism configured to cause said dresser to swing on the upper surface of the polishing pad in radial directions of the polishing pad;

a dresser position measuring device configured to measure a radial position of said dresser on the upper surface of the polishing pad;

a cutting rate measuring device configured to measure a cutting rate of the polishing pad dressed by said dresser;

a polishing pad profile measuring device configured to obtain a profile of the polishing pad from the cutting rate of the polishing pad measured at plural zones defined in the upper surface of the polishing pad, positions of the plural zones being measured by said dresser position measuring device;

a dresser operation controller configured to control an operation of said dresser; and a substrate profile measuring device configured to measure a removal profile of a film on the substrate, wherein the profile of the polishing pad measured by said polishing pad profile measuring device is fed back to said dresser operation controller, and the removal profile of the film on the substrate measured by said substrate profile measuring device is fed back to said top ring operation controller.

12. The substrate polishing apparatus according to claim 11, wherein:

said dresser swinging mechanism includes a motor comprising a position control motor or a pulse motor as a drive source for swinging said dresser arm; and said dresser position measuring device is configured to measure the radial position of said dresser from a pulse number supplied to said motor.

13. A substrate polishing apparatus comprising:

a polishing table for supporting a polishing pad;

a top ring configured to rotate a substrate and press the substrate against the polishing pad at a predetermined force while rotating the substrate, said top ring having a substrate holding surface which is divided into plural regions;

a top ring operation controller configured to control an operation of said top ring;

a dresser configured to rotate about its own axis and dress the polishing pad by pressing an upper surface of the polishing pad at a predetermined force, said dresser being coupled to a dresser arm;

a dresser swinging mechanism configured to cause said dresser to swing on the upper surface of the polishing pad in radial directions of the polishing pad;

a dresser position measuring device configured to measure a radial position of said dresser on the upper surface of the polishing pad;

a cutting rate measuring device configured to measure a cutting rate of the polishing pad dressed by said dresser;

a polishing pad profile measuring device configured to obtain a profile of the polishing pad from the cutting rate of the polishing pad measured at plural zones defined in the upper surface of the polishing pad, positions of the plural zones being measured by said dresser position measuring device;

a dresser operation controller configured to control an operation of said dresser; and a pressing force controller configured to control pressing forces of the regions in said substrate holding surface in accordance with a thickness of the polishing pad based on the profile of the polishing pad measured by said polishing pad profile measuring device.

* * * * *